United States Patent [19]

Busenhart et al.

[11] Patent Number: 5,033,685

[45] Date of Patent: Jul. 23, 1991

[54] APPARATUS FOR MONITORING THE PRESSING FORCE OF A CONTACT ROLL IN A TEXTILE YARN WINDER

[75] Inventors: Peter Busenhart, Winterthur; Armin Wirz, Ossingen, both of Switzerland

[73] Assignee: Maschinenfabrik Rieter, AG, Winterthur, Switzerland

[21] Appl. No.: 442,071

[22] Filed: Nov. 28, 1989

[30] Foreign Application Priority Data

Nov. 28, 1988 [CH] Switzerland ..... 04408/88
Jun. 15, 1989 [CH] Switzerland ..... 02258/89

[51] Int. Cl.[5] ..... B65H 54/00; B65H 54/52

[52] U.S. Cl. ..... 242/18 R; 242/18 B; 242/18 DD

[58] Field of Search ..... 242/18 DD, 18 R, 18 A, 242/65, 18 B

[56] References Cited

U.S. PATENT DOCUMENTS 2,463,773 3/1949 Jencks ..... 242/18 R
2,466,109 4/1949 Jencks ..... 242/18 R
3,617,009 11/1971 Lawson et al. ..... 242/18 R
4,087,055 5/1978 Yasuda et al. ..... 242/18 DD
4,106,710 8/1978 Schippers et al. ..... 242/18 R
4,394,985 7/1983 Graf et al. ..... 242/18 DD

*Primary Examiner*—Stanley N. Gilreath
*Attorney, Agent, or Firm*—Burns, Doane Swecker & Mathis

[57] ABSTRACT

A yarn winding machine is equipped with transducer means (39) disposed in the area of the ends (33, 35) of the contact roll shaft (37) to monitor the pressing force of the contact roll (11) against the yarn package (9) being wound. The short paths between the sensors and the areas where the contact roll presses against the surface of the yarn path makes it possible to measure the downward pressure at the individual measurement points or as a whole. The signals can be used to control the pressing force and also to maintain the parallelism of the axes (A, B) of the spool mandrel (5) and of the contact roll (11).

19 Claims, 4 Drawing Sheets

APPARATUS FOR MONITORING THE PRESSING FORCE OF A CONTACT ROLL IN A TEXTILE YARN WINDER

FIELD OF THE INVENTION

This invention relates to yarn winding apparatus in which yarn is wound into at least one yarn package carried by a rotatable mandrel and in which a contact roll presses against the outer surface of the yarn package as it is being built up. The invention is concerned particularly with a monitoring system for the pressing force of the contact roll pressing against the surface of the yarn package and for exerting control over certain of the machine components in response to the sensed pressing forces.

BACKGROUND OF THE INVENTION

Winding machines of the type used to build up large packages of synthetic filament yarns typically employ overhung or cantilever mandrels about which the yarns are wound as the mandrels rotate about their axes. Such machines will be referred to here at times as spooling frames and the yarn packages as spools. The cantilever or overhung type mounting for such a mandrel leaves on end of the mandrel free and accessible for the endwise insertion thereover of empty fiber (e.g. paper) tubes onto which the yarn may be wound and for the endwise removal therefrom of the full yarn packages formed as a result of the winding of the yarn onto the fiber tubes.

A contact roll ordinarily is disposed above the operative position of the mandrel on which the yarn packages are wound. Its mounting arrangement is such that it may move vertically as necessary in view of the changing diameter of the yarn packages as these are being built up. Means also are provided to press the contact roll downwardly to provide the desired contact with the peripheries of the yarn packages.

In some machines the contact roll is the driving roll for rotating the mandrel through friction with the yarn package on the mandrel. In other machines the contact roll is a speedometer roll which frictionally contacts the outer surface of the building yarn package to sense the peripheral speed thereof and provide an input signal for a drive for the mandrel. In all of these cases, however, it is desirable that the contact roll press with reasonable uniformity against substantially the entire length of all the yarn packages being wound on a mandrel at a given time If only a single short spool or yarn package is built up on the spool mandrel, the pressing force can be kept within the desired limits by well-known means. Here, the small differences in parallelism between the mandrel and the contact roll which arise as the yarn package builds up do not greatly affect the quality of the package. However, problems may arise in larger capacity operations and/or in machine structures wherein the contact rolls are loaded unevenly.

U.S. Pat. No. 4,106,710 proposes that a fork-shaped mount of a driving roll for contacting and rotating a yarn package should be supported on two diaphragm cylinders charged with compressed air, and that the desired pressure should be applied to the roll. These diaphragm cylinders have a complicated design, and they are pressed together as the diameter of the spool increases. This continuously raises the pressing pressure of the driving roll, until the mounting of the diaphragm cylinder is conducted radially away from the spool by means of a path sensor.

This known apparatus has the disadvantage that the pressing pressure of the contact roll is sensed only indirectly through the feed pressure of the diaphragm cylinders.

SUMMARY OF THE INVENTION

According to the present invention, apparatus is provided for monitoring the pressing force of the contact roll against the yarn package, so that the pressing force can be ascertained exactly at any time and its signals can be used as needed to control the applied pressure.

Connecting a transducer or dynamometer directly between the contact roll shaft and the means for supporting this shaft makes it possible to sense with great precision changes in the pressing force of the contact roll at the surface of the yarn package. In particular, even small deviations from the parallelism of the axes of the mandrel and the contact roll shaft can readily be ascertained, and the resulting signal can be used for corrective measures. Such deviations may arise, for example, as increasingly heavy yarn packages on a cantilever mandrel in a yarn winding machine cause the mandrel axis to tilt down away from the machine frame.

The degree to which the control of the press-on pressure is affected can be minimized by using a so-called "short-path" measuring arrangement. The dynamometers or sensor preferably are placed on the shaft ends or in the area of the shaft ends to make it possible advantageously to sense the forces at the nearest possible point to the yarn package surface. A bending of the mount and/or other parts thus does not affect materially the results or the measurement.

Dynamometer bearings, which are placed directly on the contact roll shaft, can be used economically to perform the force measurement using commercial elements.

Other transducer or pressure sensor elements inserted at locations between the ends of the contact roll shaft make it possible to sense and control the press-on pressure in the central region of the contact roll. In this way, the press-on pressure on each individual spool or yarn package can also be monitored, if a plurality of spools are simultaneously built up next to one another on a spool mandrel. The signals from the dynamometers can be displayed and processed individually or as a total.

This creates the preconditions for influencing the pressing force on the yarn package parallel to its rotation axis or to make appropriate corrections in case there is a lack of parallelism. Also, the signals from the sensors can advantageously be used to monitor the rotational speed in dependence on the press-on pressure, if desired.

BRIEF DESCRIPTION OF THE DRAWINGS

The invention now will be explained in more detail with reference to an embodiment illustrated in the accompanying drawings, in which.

DETAILED DESCRIPTION OF PREFERRED EMBODIMENT

Figure 1:
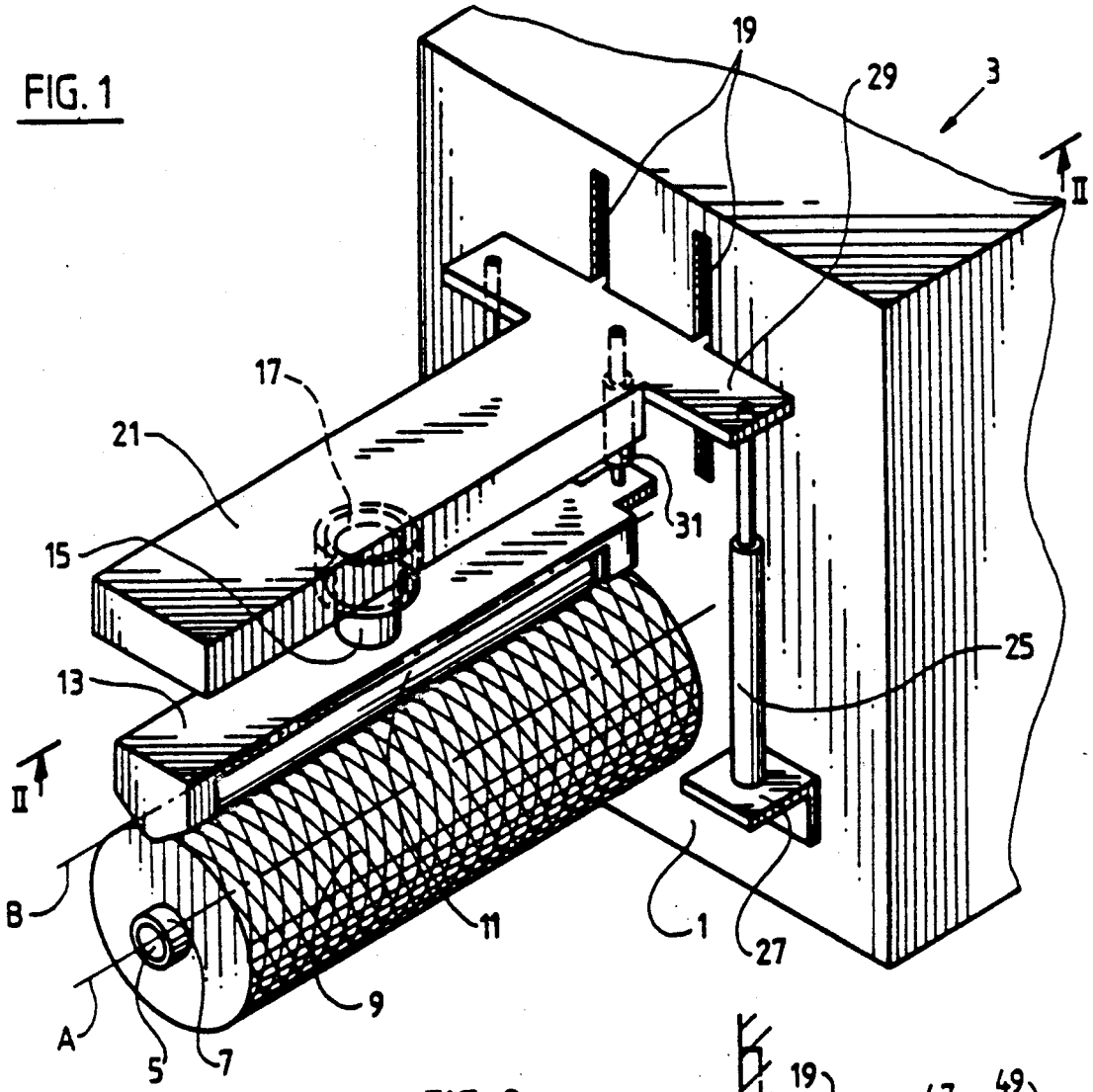
FIG. 1 is a partial perspective representation of a spooling frame or winding machine of a type suitable for incorporation of the present invention, but omitting the yarn traverse mechanism.

The general type of winding machine 3 shown diagrammatically in FIG. 1 should be understood to be representative of both automatic and manual take-up winders employed to form large yarn packages 9 from synthetic filaments. Although only one rotatable mandrel 5 for holding the yarn packages 9 being wound is shown, it should be understood that automatic winding machines of this type frequently include a pair of spool mandrels mounted on a revolving turret so that an inactive mandrel may be moved into an active position to replace a mandrel on which the winding of one or more yarn packages of the desired size has been completed. The full mandrel then may have the yarn packages removed therefrom, and it will remain in an inactive position for a time until the winding of the next yarn packages have been completed.

Whether the machine is equipped with one mandrel or with two turret mounted mandrels, the mount of each mandrel 5 will be one in which the end of the mandrel remote from the mounting structure will be free and unobstructed as shown at the left in FIG. 1. This permits easy insertion over the free end of a mandrel of the empty sleeves 7 (such as paper tubes) onto which the yarns are to be wound and easy removal of the full yarn packages endwise off the free end of the mandrel. The bearings by which the cantilever type of mounting is achieved for each mandrel 5 may if desired be resiliently supported as indicated in U.S. Pat. No. 4,087,055. Conventional means on the mandrel hold the sleeves against rotation relative to the mandrel during the winding operations. Automatic doffing apparatus may be employed with such mandrels if desired.

In a machine of this type, a suitable traverse mechanism will be located above the mandrel 5 in position to contact the yarns as they pass from their sources (e.g. from synthetic filament extrusion equipment) into the rotating yarn packages 9. The traverse mechanism moves each yarn back and forth lengthwise of its yarn package 9 to cause a generally level buildup of multiple yarn layers within the yarn packages 9.

Figure 2:
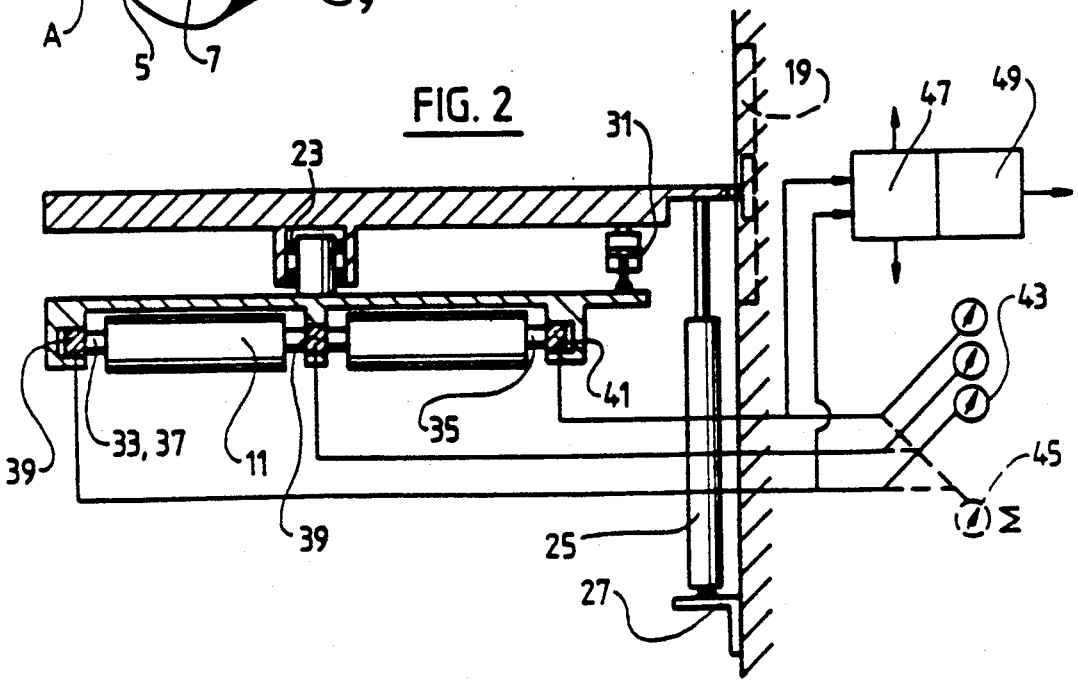
FIG. 2 is a schematic representation of yarn winding machine components wherein a contact roll is equipped in accordance with the present invention with the dynamometers or sensors at the shaft ends of the roll and wherein evaluation means are provided to receive the signals from such sensors.

A contact roll 11 is located above the mandrel 5 for bearing against the surfaces of the yarn packages 9. Such contact roll may be of substantially uniform diameter along its entire length as indicated in FIG. 1 or it may be segmented as indicated in FIG. 2. In this latter connection, it will be understood that one or a plurality of side-by-side yarn packages may be built up simultaneously on a given mandrel 5.

Figure 7:
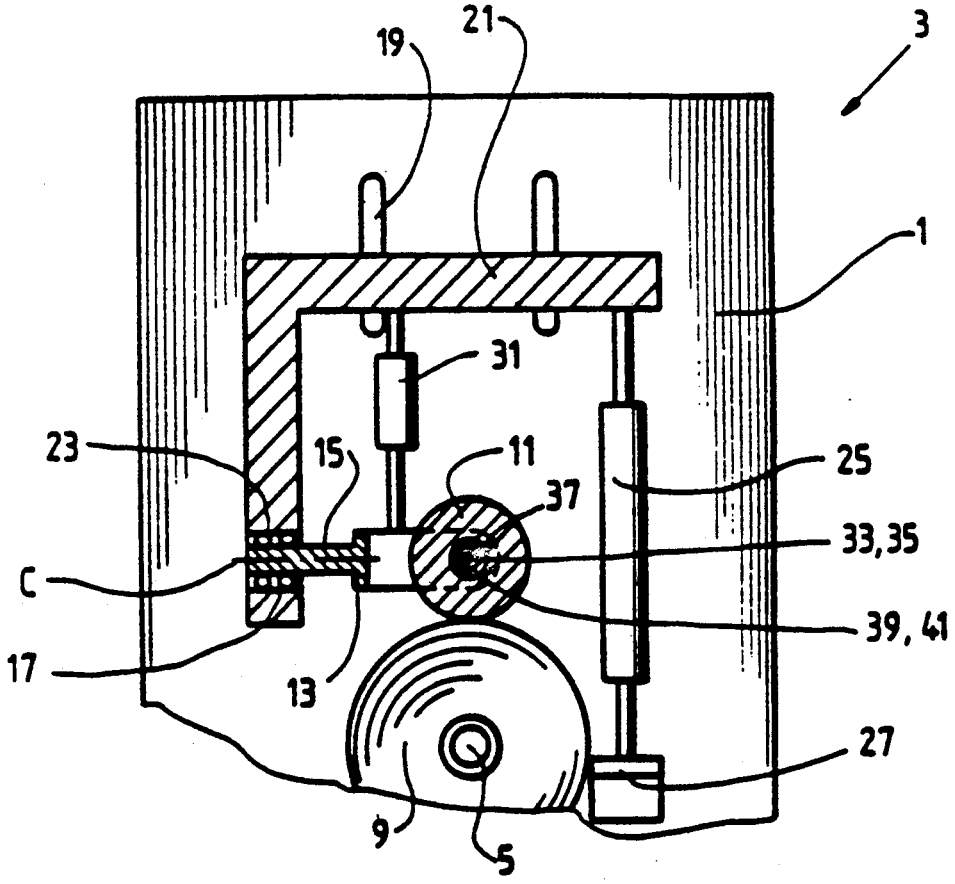
FIG. 7 shows a cross-section through another simplified embodiment without intermediate supports.

The contact roll 11 is rotatably mounted above the yarn package 9 in a fork-shaped holding means or yoke 13. The rotational axis A of the mandrel 5 is essentially parallel to the axis B of the contact roll 11. In the present example, the holding means 13 for the contact shaft 11 is mounted by means of a cylindrical peg 15, in a hole 17 of a support or carrier 21, which is movably disposed in vertical guide grooves 19 in the front wall 1 of the machine frame 3. The peg 15 can be connected to the hole 17 by means of O-rings 23 inserted into the ring space. However, this particular connection is not essential in all instances. Different types of mountings are possible, and other O-ring connection arrangements have been depicted in other views. The arrangement shown in FIG. 7 is particularly preferred.

To move the carrier 21 vertically, pneumatic cylinders 25 or other power means for exerting force linearly are installed at the front wall 1 of the winding machine 3. The pneumatic cylinders 25 are fastened on the one hand on a support 27 in the machine housing and on the other hand at a bracket 29 on the carrier 21.

The yoke 13 for holding the contact roll 11 can be connected laterally to another linear drive 31, e.g. a pneumatic cylinder, which makes it possible to swing the rotation axis B of the contact roll 11, relative to the rotation axis A of the spool mandrel 5. The power means 31 may be interposed between portions of the yoke 13 and the carrier 21 as indicated in FIGS. 1–4 and connected to these parts through suitable means (e.g. pivots) so that undesired binding will not occur upon slight swinging movements of the yoke relative to the carrier 21.

Instead of moving the holding means 13 with respect to the spool mandrel 5, means can also be used to move the spool mandrel 5 with respect to the contact roll 11.

According to FIG. 2, the ends 33 and 35 of the shaft 37 which supports the contact roll 11 are held in dynamometers or transducer means 39 and 41. The transducer means 39 and 41 can be designed as dynamometer bearings, or pressure-sensitive measuring elements can be inserted between the conventional bearings of the contact roll 11.

The two sensors 39 and 41 are each connected to a display means 43. One display means 43 displays the instantaneous forces at an end 33 of the contact roll 11 while a separate display means 43 displays the forces at the other end 35 of the roll 11. An additional display means 45 can also be provided to display the total or sum of the forces at the measurement points.

If desired, some or all of the sensed signals or values derived therefrom may be compared with expected or standard values to reveal deviations. For example, an evaluation means 47 may compare the incoming actual values with pre-established theoretical values. Also, information storage means may be provided. An electronic memory 49 can be connected to the evaluation means 47, to store or print out the measured values.

Figure 3:
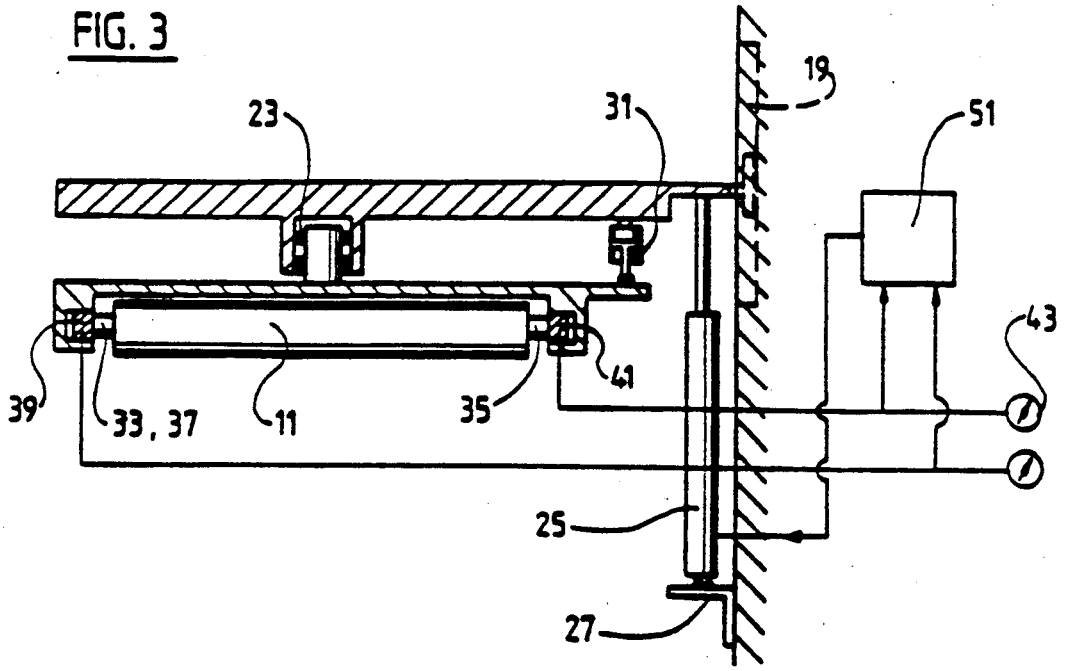
FIG. 3 shows a contact roll analogous to FIG. 2, with a control circuit to activate the pressure cylinder for pressing the roll downwardly.

In the embodiment of FIG. 3, the signals from the dynamometers 39 and 41 are used to activate the linear drives 25, to bring about changes in the radial distance of the contact roll 11 from the spool axis A and or changes in the downward pressure applied to the carrier 21. A control circuit 51 triggers activation of these linear drives 25.

Figure 4:
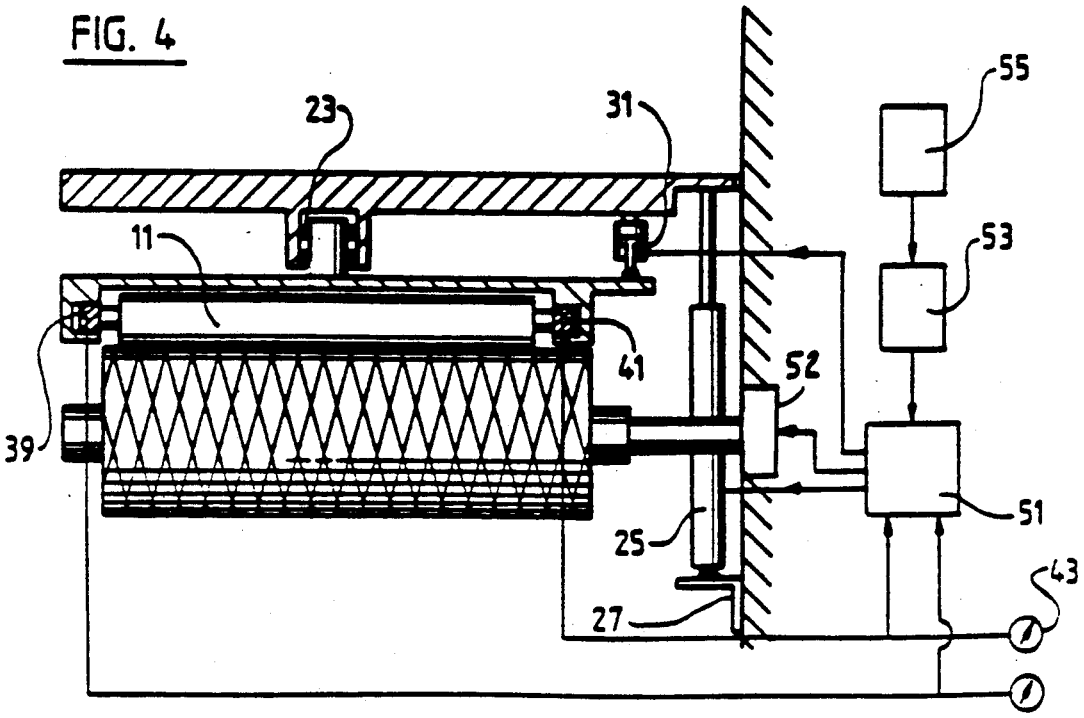
FIG. 4 shows a contact roll analogous to FIG. 3, with a control circuit to activate a cylinder which controls the position of the contact roll relative to the spool mandrel axis.

In the embodiment according to FIG. 4, still another aspect of control based upon the pressure values sensed by the transducers 39 and 41 is contemplated. As indicated in this Figure, control is exerted not only on the cylinders 25 for bodily moving the carrier 21 in a vertical direction but also on the linear drive or cylinder 31 for tilting the axis B of the contact roll 11 relative to the axis A of the mandrel 5. Such action is especially desirable when due to the presence of one or more heavy yarn packages on the mandrel 5, such mandrel 5 sags downwardly at its free end and the position of the axis needs to be corrected. Furthermore, the rotational speed of the spool 9 can also be adapted to the measured circumstances. Appropriate signals are conducted to a regulation device 52 such as a motor via a control device 55 and a transmitter 53 for the theoretical values.

Figure 5:
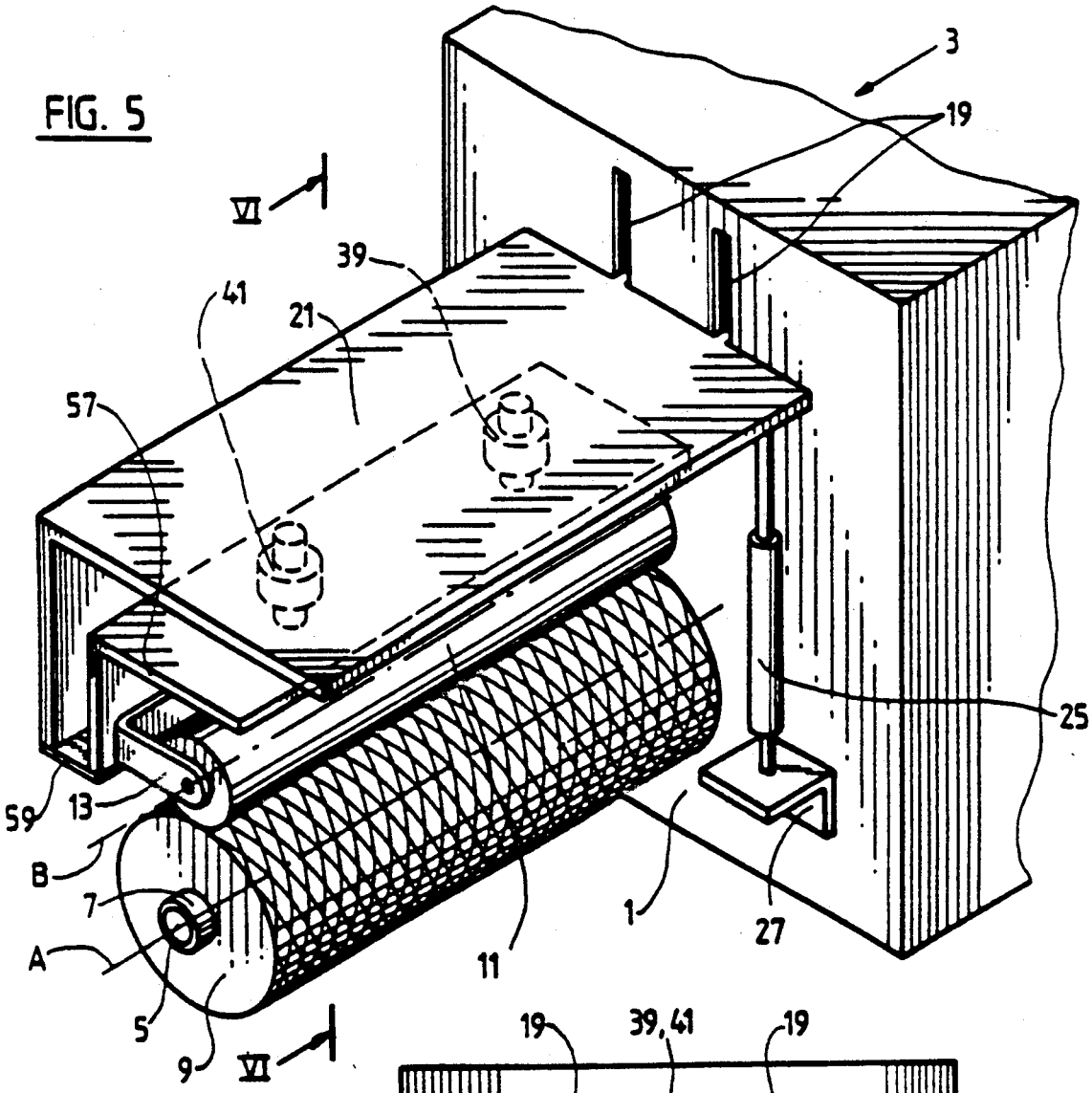
FIG. 5 shows a perspective view of a contact roll suspended so that it can swing.

In the embodiment of the invention according to FIG. 5, the yoke or holding means 13 for the contact roll 11 is not mounted directly in the vertically movable support or carrier 21 of the machine. An intermediate support 57 is inserted between the holding means 13 and the support 21. This intermediate support contains the hole 17, which is engaged by the cylindrical peg 15 of the holding means 13, the peg 15 being retained flexibly by means of the O-ring 23. At its top side, the support 57 is connected to the support 21 by means of the dynamometers 39 and 41. At its lower edge, the connection between the intermediate support 57 and the support 21 consists of a thin flexible sheet 59.

If the two axes A and B deviate from parallelism due to the sagging of axis A, the contact roll can correct the deviation about the axis C of the cylindrical peg 15. At the same time, the transducers 39 and 41 provide a measure of the total pressing force of the contact roll 11 on the yarn package 9, provided, of course, that the masses of the intermediate support 57, of the holding means 13, and of the contact roll 11 are appropriately taken into account.

Another particularly preferred embodiment of the invention is depicted in FIG. 7. Here, the ends of the contact roll 11 are mounted in bearings in a yoke in a manner which corresponds to the suspension arrangement shown in FIGS. 1 through 4. In FIG. 7, however, the axis C of the peg and socket connection between the carrier 21 and the yoke 13 is generally horizontal and located approximately midway between the ends of the contact roll. The cylindrical peg 15 extends rearwardly from a midportion of the yoke 13 to enter the cylindrical socket 17 in a vertical leg of an L-shaped carrier 21 and rubbery O-rings frictionally engage both the wall of the socket 17 and the surface of the peg. The pressing force is measured at the ends 33 and 35 of the contact roll by means of annular sensors or dynamometers 39 and 41, which can be a part of the bearings that support the contact roll shaft 37.

Figure 6:
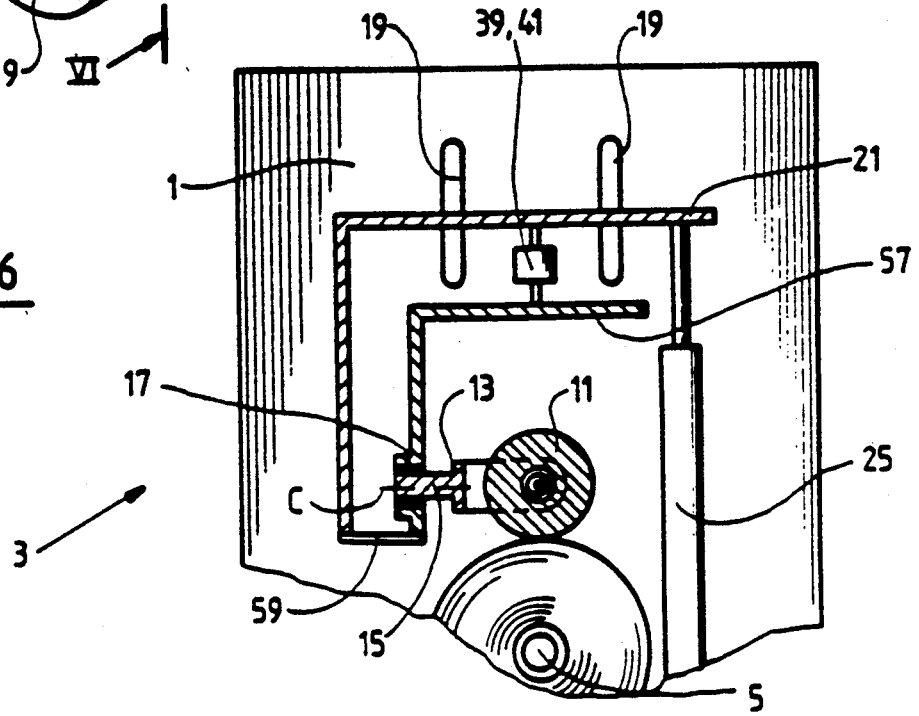
FIG. 6 shows a cross-section along line VI—VI in FIG. 5.

In the embodiments according to FIGS. 5 through 7, conventional commercial transducers or dynamometers may be used as the measuring elements 39 and 41. The data measured at the sensors 39 and 41 can be evaluated in a manner analogous to that described above in connection with FIGS. 2 through 4.

What is claimed is:

1. Yarn winding apparatus for winding textile yarns to form yarn packages, comprising an axially elongated rotatable mandrel for the yarn packages being wound;

a carrier movable toward and away from the axis of rotation of said mandrel;

a contact roll swingably mounted with respect to said carrier so as to permit one end of said contact roll to be disposed closer to said axis of rotation of said mandrel than the other end of said contact roll and being rotatable about an axis generally parallel to said axis of rotation of said mandrel for pressing against the outer surfaces of the yarn packages being wound;

means for pressing said carrier toward said mandrel to cause said contact roll to apply pressing forces to the outer surfaces of the yarn packages being wound; and pressure sensors for separately sensing pressing forces at opposite end portions of said contact roll as said contact roll presses against said yarn packages.

2. Yarn winding apparatus according to claim 1, wherein the opposite end portions of said contact roll are rotatably mounted in bearings and wherein respective ones of said pressure sensors are associated with each of said bearings to generate an electrical signal indicative of the pressing forces transmitted through said bearings.

3. Yarn winding apparatus according to claim 1, including a yoke rotatably supporting opposite end portions of said contact roll and itself being connected to said carrier for tilting movement with respect to the axis of rotation of said mandrel.

4. Yarn winding apparatus according to claim 3, including power means responsive to signals from said sensors for tilting said yoke.

5. An apparatus for monitoring, while a yarn spool is being built up on a spooling frame, the pressing force of a radially movable contact roll against the spool, comprising holding means to support the contact roll, pressing means for urging together the spool being wound and said holding means with said contact roll thereon, and a separate dynamometer inserted between the ends of the contact roll and a support, the means which supports the contact roll being connected to the support by means of a pivot peg so as to be tiltable with respect to the axis of rotation of the spool being wound.

6. The apparatus of claim 5, wherein said contact roll has shaft ends protruding therefrom, and wherein the dynamometers are set on the shaft ends of the contact roll.

7. The apparatus of claim 6, wherein the dynamometers are in the form of dynamometer bearings.

8. The apparatus of claim 5, wherein said contact roll is provided with a shaft and wherein at least one other dynamometer is connected to a central section of the contact roll shaft.

9. The apparatus of claim 5, wherein an intermediate support is disposed between the support and the holding means, the holding means being mounted in said intermediate support, and wherein the intermediate support is fastened to the support by at least one dynamometer and at least one flexible connection element.

10. The apparatus of claim 5, including means for displaying individually signals from the dynamometers.

11. The apparatus of claim 5, including means for adding together signals from the dynamometers and displaying the total.

12. The apparatus of claim 5, including means for combining signals from the dynamometers and displaying the average of the signals from all the dynamometers.

13. The apparatus of claim 5, including a control circuit and means for processing signals from the dynamometers in said control circuit to activate the pressing means.

14. The apparatus of claim 5, including means responsive to signals of said dynamometers for tilting said holding means relative to the axis of the spool being wound.

15. A yarn winding machine comprising a generally horizontal rotatable mandrel for receiving a sleeve onto which the yarn may be wound during rotation of the mandrel to build up a yarn package, said mandrel being supported so as to provide a free end thereof onto which sleeves may be inserted and removed axially of the mandrel;

a contact roll generally parallel to said mandrel for pressing against the yarn package being built up during rotation of said mandrel;

a yoke for rotatably mounting said contact roll at both of the ends thereof in a position above said mandrel;

a carrier for said yoke, said carrier being movable bodily in a direction to position said contact roll closer to or farther from said mandrel, said carrier being connected to said yoke through a connection that includes a peg projecting from one of said yoke and carrier at a location between the ends of said contact roll, an opening in the other of said yoke and carrier surrounding and spaced from said peg, and at least one flexible resilient O-ring in surrounding relation to said peg in the space between and contacting said peg and said opening;

means for applying a pressing force downwardly on said carrier with the pressing force being transmitted through said O-ring to said yoke and thence to the end portions of said contact roll; and pressure sensors for separately sensing pressing forces at opposite end portions of said contact roll as said contact roll presses against said yarn package.

16. A yarn winding machine according to claim 15, including means operating in response to signals from said sensors for controlling said means for applying a pressing force downwardly on said carrier in response to signals from said sensors.

17. A yarn winding machine according to claim 15, additionally comprising power means on said carrier for applying a force to said yoke tending to tilt said yoke about said peg.

18. A yarn winding machine according to claim 17, including means operatively connecting said pressure sensors to said power means to operate said power means in response to signals from said sensors.

19. A yarn winding machine according to claim 15, additionally including motor means for rotatably driving said mandrel and means operatively connected to said sensors for controlling said motor in response to signals from said sensors.

* * * * *